US007945188B2

(12) United States Patent
Arimura

(10) Patent No.: US 7,945,188 B2
(45) Date of Patent: May 17, 2011

(54) IMAGE FORMING APPARATUS WITH A CLEANING OPERATION TO IMPROVE IMAGE QUALITY

(75) Inventor: Koji Arimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 742 days.

(21) Appl. No.: 11/565,131

(22) Filed: Nov. 30, 2006

(65) Prior Publication Data

US 2007/0127938 A1 Jun. 7, 2007

(30) Foreign Application Priority Data

Dec. 5, 2005 (JP) ..... 2005-351363

(51) Int. Cl.
*G03G 15/02* (2006.01)

(52) U.S. Cl. ..... 399/100; 399/302; 399/308

(58) Field of Classification Search ..... 399/100, 399/176, 174, 66, 50, 302, 308
See application file for complete search history.

(56) References Cited

U.S. PATENT DOCUMENTS

| | | | | |
|---|---|---|---|---|
| 5,765,076 | A * | 6/1998 | Ogata et al. | 399/168 |
| 5,839,026 | A * | 11/1998 | Ko | 399/100 |
| 6,449,448 | B2 * | 9/2002 | Bessho et al. | 399/149 |
| 6,529,698 | B1 * | 3/2003 | Nagata | 399/148 |
| 6,591,072 | B2 * | 7/2003 | Hashimoto et al. | 399/50 |

FOREIGN PATENT DOCUMENTS

| | | |
|---|---|---|
| JP | 2001-75454 A | 3/2001 |
| JP | 2003-091146 | 3/2003 |

OTHER PUBLICATIONS

Machine Translation of Tsukida et al. JP-2001-075454.*
Chinese Office Action mailed Jul. 4, 2008 in Application No. 200610164238.3, with English-language translation.
English-language translation of JP 2001-75454 A (Tsukida et al.)

* cited by examiner

*Primary Examiner* — David M Gray
*Assistant Examiner* — G. M. Hyder
(74) *Attorney, Agent, or Firm* — Fitzpatrick, Cella, Harper, & Scinto

(57) ABSTRACT

An image forming apparatus includes an image bearing member, a charging member, a toner image forming device for forming an image on the image bearing member, and an intermediary transfer member for carrying a toner image. A cleaning member removes toner remaining on the image bearing member, a speed switching device selectively set a speed of the recording material, and an intermediary transfer member speed switching device switches a rotational speed of the intermediary transfer member after the toner image is transferred. A charging control device render off a DC voltage applied to the charging member after transfer of the toner image and while the intermediary transfer member is carrying the toner image. A charging member cleaning control devices permits, when a signal for starting image formation is inputted, a cleaning operation for discharging toner deposited on the charging member to the image bearing member before starting the image formation.

5 Claims, 6 Drawing Sheets

$$\text{AVE.SPHERICITY } C = \sum_{i=1}^{m} c_i / m$$

FIG.7

| CONDITIONS | DRUM POT. | 1RY CHRG POT. | DISCHARGE TIME(S) | IMAGE CONTAMINATION PREVENTION |
|---|---|---|---|---|
| 1 | -150V | 0V | 10 | G |
| 2 | -150V | 0V | 0 | N |
| 3 | -150V | 0V | 2 | F |
| 4 | -150V | 0V | 30 | G |
| 5 | 0V | 0V | 10 | N |

G:GOOD
F:FAIR
N:NO GOOD

FIG.8

IMAGE FORMING APPARATUS WITH A CLEANING OPERATION TO IMPROVE IMAGE QUALITY

FIELD OF THE INVENTION AND RELATED ART

The present invention relates to an image forming apparatus, such as a laser printer, which constitutes the output portion of a copying machine or a facsimile machine, or an output device for a computer or the like. In particular, it relates to an image forming apparatus in which a toner image formed with the use of a contact charging member is transferred onto an intermediary transferring member, and then, the image on the intermediary transferring member is transferred onto recording medium.

There are various cleaning methods for cleaning the image bearing member (for example, photosensitive drum) of an image forming apparatus, such as a copying machine, a printer, etc. Among these cleaning methods, those which employ a cleaning blade as a cleaning member have been widely used. In these methods, a piece of elastic plate as a cleaning blade, for example, is pressed upon the peripheral surface of an image bearing member. More specifically, the elastic plate is anchored to a holder (holding member) by one of its edge portions so that the opposing edge portion is pressed upon the peripheral surface of the image bearing member by utilizing the elasticity of the elastic plate. In operation, the elastic plate and the peripheral surface of the image bearing member are moved relative to each other to rub the peripheral surface of the image bearing member with the elastic blade so that the toner remaining on the peripheral surface of the image bearing member after image transfer is scraped away (removed) by the abovementioned edge portion of the elastic plate.

In recent years, the toner manufactured by polymerization (which hereafter will be referred to as "polymer toners") has come to be widely used as the toner for an image forming apparatus, in particular, a full-color image forming apparatus. Polymer toner is higher in sphericity, more uniform in particle diameter, and far better in transferability than toner manufactured by pulverization, that is, one of the conventional toner manufacturing methods. Further, the amount of the energy consumed for manufacturing polymer toner is remarkably smaller than that for manufacturing the conventional toner by pulverization. Therefore, polymer toner has been known as the toner which can reduce the effect of toner production upon environment.

However, polymer toner is manufactured by causing molecules to polymerize in suspension. Therefore, a polymer toner particle is not irregular on the surface; it is almost truly spherical. Therefore, polymer toner is likely to become extremely densely packed. Thus, convective toner movement, which contributes to the removal of toner does not occur. Therefore, when polymer toner is used for image formation, it is very difficult to remove the residual toner. In particular, if a large amount of polymer toner is delivered to the contact area (cleaning nip) between an image bearing member and a cleaning blade, the toner slips under the cleaning blade by an amount which is not large enough to affect image quality.

As a primary charging means for charging an image bearing member, a multilayer charge roller has been widely used, which is made up of a metallic rod as a core, an electrically conductive foamed rubber layer coated on the peripheral surface of the metallic core, etc. In a charging method which employs a charge roller (multilayer charge roller), an image bearing member is charged by pressing a charge roller upon the peripheral surface of an image bearing member (charging method of contact type), rotating thereby the charge roller by the rotation of the image bearing member, while applying bias to the charge roller. The charge bias, or the bias applied to the charge roller, is a combination of DC voltage, and AC voltage, the peak-to-peak voltage of which is twice the charge start voltage. The bias applied to the charge roller is controlled so that the DC voltage of the charge bias remains constant in amplitude, whereas the AC voltage of the charge bias remains constant in current value. The application of AC voltage, in addition to DC voltage, to the charge roller makes it more likely for the surface potential of the image bearing member to converge to a target voltage than the application of DC voltage alone. Thus, the application of AC voltage, in addition to DC voltage, to the charge roller makes it possible to obtain a high quality image.

However, an image forming apparatus, in which its image bearing member is charged by applying DC voltage and AC voltage to its charge roller, suffers from the following problems. That is, as the cumulative length of time the image bearing member is charged increases, by-products, such as nitrile oxide, which results from the charging process adhere to the peripheral surface of the image bearing member, reducing thereby the image bearing member in slipperiness. In addition, the AC voltage causes the cleaning blade and image bearing member to vibrate, allowing a large mount of microscopic particles in the cleaning nip to slip out all at once from the cleaning nip. Thus, if the cleaning nip is not replenished with microscopic particles, such as those in toner, the friction between the cleaning blade and image bearing member increases, being therefore likely to cause the cleaning blade to generate noises or vibrate, and/or pull the functional edge portion of the cleaning blade into the interface between the cleaning blade and image bearing member, which in turn reduces the cleaning apparatus in cleaning performance. Therefore, the charging time must be prevented from being wastefully prolonged.

As toner is delivered to the cleaning nip, a very small amount of toner slips through the cleaning nip, lubricating thereby the opposing surfaces of the blade and image bearing member. The toner conveyed to the cleaning blade contains positively charged toner particles and negatively charged toner particles. The amount of the electrostatic force by which the positively charged toner particles are attracted to the negatively charged image bearing member is greater than that by which the negatively charge toner particles are attracted to the negatively charged image bearing member. Therefore, the ratio of the positively charged toner particles in the toner having slipped through the cleaning nip is likely to be greater than the ratio of the negative charge toner particles in the toner having slipped through the cleaning nip.

After slipping through the cleaning nip, the positively charged toner particles transfer onto the charge roller, which is greater in the absolute value of potential than the image bearing member while being the same in polarity as the image bearing member, during an image forming operation, and are retained by the charge roller.

As the bias which is being applied to the charge roller is reduced to zero, these positively charged toner particles having adhered to the charge roller are transferred onto the photosensitive drum, and adhered thereto, by the difference in potential level between the charge roller and photosensitive drum. Thus, various methods have been devised to solve this problem. For example, Japanese Laid-open Patent Application 2003-91146 discloses one of such solutions. According to this patent application, the toner having adhered to the charge roller is removed by using the difference in potential level between the charge roller and photosensitive drum.

Also in recent years, the number of recording media on which an image can be formed by an image forming apparatus has been increasing. For example, it has become possible to use an image forming apparatus to form an image on cardstock and the like special medium, that is, recording media other than ordinary recording paper. Thus, in order to ensure that a toner image is satisfactorily fixed to cardstock or the like, some of the recent image forming apparatuses are rendered variable in process speed and/or recording medium conveyance speed so that they can be operated at a speed different from the speed at which it is operated to form an image on ordinary paper. Regarding the variability in the operational speed of an image forming apparatus, such as the abovementioned one, an image forming apparatus is desired to be designed so that even if the image forming apparatus is in the low speed mode, it is not operated at a reduced speed up to a certain point in an image forming sequence, that is, even when an image forming apparatus is in the low speed mode, an image formation sequence is carried out at the normal speed until the completion of the image formation on an image bearing member, and then, the process speed is reduced before the transferring of the toner image onto recording medium is started.

Therefore, in the case of a color image forming apparatus designed as described above, its process speed is switched immediately after a color image is borne on its intermediary transferring member.

That is, by the time the color image forming apparatus is switched in process speed, the formation of an image on the photosensitive drum will have been completed. Therefore, it is not problematic to stop the application of bias to the charge roller when switching the color image forming apparatus in process speed.

However, as the application of bias to the charge roller is stopped, the toner on the charge roller transfers onto the photosensitive drum due to the relationship between the potential level (virtually zero) of the charge roller and the residual potential of the photosensitive drum, creating therefore the problem that the toner having transferred from the charge roller to the photosensitive drum adheres to the toner image on the intermediary transferring member, disturbing thereby the image.

On the other hand, if the application of bias to the charge roller is kept on, the photosensitive drum is shaved more, and/or the by-products of the charging process negatively affects the performance of the cleaning apparatus, as described above. In consideration of these adverse effects, it is not desirable to continue the application of bias to the charge roller after the completion of the image formation on the photosensitive drum.

SUMMARY OF THE INVENTION

The primary object of the present invention is to provide an image forming apparatus which is substantially smaller, in the adverse effects which the toner having adhered to the charging member has on image quality after the bias applied to the charge roller is turned off after the transfer of a toner image onto the intermediary transferring member.

According to an aspect of the present invention, there is provided an image forming apparatus comprising a rotatable image bearing member; a charging member contacted to said image bearing member to charge said image bearing member; toner image forming means for forming a toner image on said image bearing member; an intermediary transfer member for carrying a toner image transferred from said image bearing member; a cleaning member for removing toner remaining on said image bearing member after transfer of the toner image; speed switching means for selectively setting a speed of the recording material from a plurality of levels; intermediary transfer member speed switching means for switching a rotational speed of said intermediary transfer member after the toner image is transferred from said image bearing member onto said intermediary transfer member; charging control means for rendering off a DC voltage applied to said charging member after transfer of the toner image onto said intermediary transfer member and during said intermediary transfer member carrying the toner image; and a charging member cleaning control means for permitting, when a signal for starting image formation is inputted, a cleaning operation for discharging the toner deposited on said charging member to said image bearing member before start of the image formation.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7 is a mathematic equation for calculating the average sphericity C of toner.

FIG. 8 is a table showing the results of the image contamination tests in which 1,000 copies were continuously printed, using cardstock, as recording medium, which was 165 g/cm$^2$ in basis weight, and which were different in the potential levels of the photosensitive drum and the length of the toner ejecting operation.

DETAILED DESCRIPTION OF THE PREFERRED EMBODIMENTS

Hereinafter, one of the preferred embodiments of the present invention will be described with reference to the appended drawings. Incidentally, if an element in one of the drawings is the same in structure and/or function as an element in another drawing, the two elements will be designated by the same referential symbol, and once one of the two elements is described, the other will not be described in an effort not to repeat the same description.

Embodiment 1

[General Structure and Operation of Image Forming Apparatus]

Figure 1:
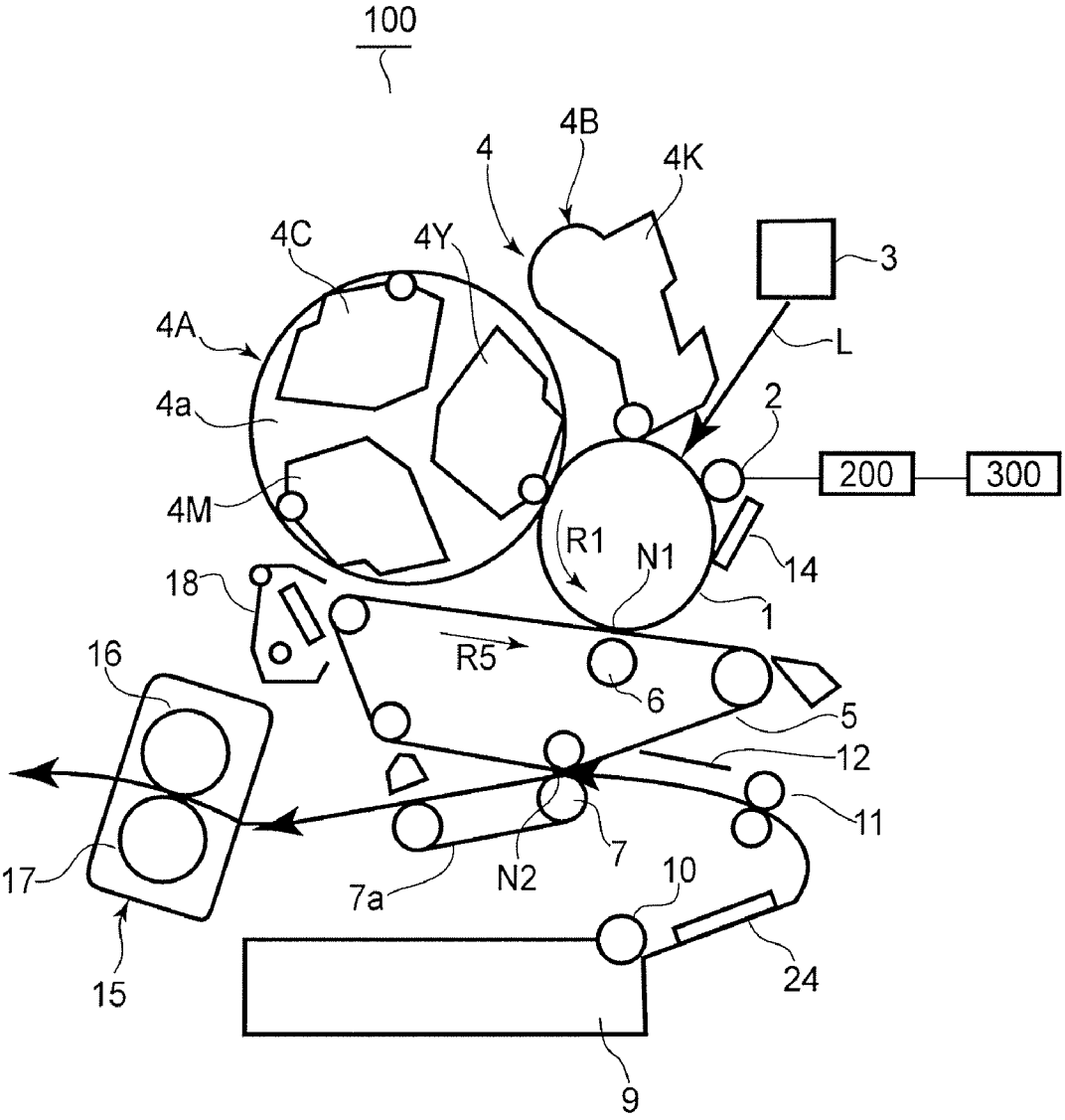
FIG. 1 is a schematic drawing of an image forming apparatus, showing the general structure thereof.

Shown in FIG. 1 is an image forming apparatus to which the present invention is applicable. The image forming apparatus shown in FIG. 1 is an electrophotographic color printer (which hereafter will be referred to as image forming apparatus) which employs an intermediary transferring means. This drawing is a front view of the image forming apparatus, more specifically, a schematic vertical sectional view of the image forming apparatus, at a plane parallel to the front panel of the apparatus, which is on the side from which a user operates the image forming apparatus. As examples of the image forming apparatus to which the present invention is applicable, a copying machine, a facsimile machine, etc., can be listed in addition to the abovementioned color printer.

The image forming apparatus 100 is provided with an electrophotographic photosensitive member 1 in the form of a rotatable drum (which hereafter will be referred to photosensitive drum). The image forming apparatus 100 in this embodiment is an image forming apparatus which forms multiple toner images different in color using a single photosensitive drum. The photosensitive drum 1 is rotationally driven by a driving means (not shown) at a preset process speed (peripheral velocity) in the direction indicated by an arrow mark R1 (counterclockwise direction). The image forming apparatus 100 is operable in two different modes in terms of process speed: high speed mode and low speed mode. The process speed in the high speed mode is roughly 138 mm/sec, whereas the process speed in the low speed mode is roughly half the process speed in the high speed mode, or roughly 69 mm/sec. As will be described later, from the beginning of the primary charging step to the end of the primary transferring step, the image forming operation is carried out at a process speed of 138 mm/sec even when the image forming apparatus is in the low speed mode. As the process speed is switched, the speed at which recording medium is conveyed is changed by a motor as a speed switching means, and the rollers, etc., to which driving force is transmitted from the motor to convey recording medium. In this embodiment, the means for switching the recording medium conveyance speed is a means for switching the rotational speed of the motor as a driving force source.

[Image Formation in High Speed Mode]

When the image forming apparatus is in the high speed mode, the photosensitive drum 1 is rotationally driven at the process speed of 138 mm/sec. As the photosensitive drum 1 is rotationally driven, it is charged to preset polarity and potential level by the charge roller 2 as the primary charging device (primary charging means). In this embodiment, a multilayer roller made up of a metallic core in the form of a rod, an electrically conductive foamed rubber coated, as a substrate layer, on the peripheral surface of the metallic core, and other functional layers coated on the substrate layer, is used as the charge roller 2. The charge roller 2 is pressed upon the photosensitive drum 1 so that it is rotated by the rotation of the photosensitive drum 1. As the charge roller 2 is rotated by the rotation of the photosensitive drum 1, charge bias, that is, a combination of DC and AC voltages, is applied to the charge roller 2 from a charge bias application power source 200. The AC voltage applied in combination with the DC voltage is an AC voltage, the peak-to-peak voltage of which is twice the charge start voltage. The charge bias application power source 200 is controlled so that the DC voltage remains constant, and the AC voltage remains constant in current value. The application of the AC voltage, in addition to the DC voltage, makes it far more likely for the potential of the photosensitive drum 1 to converge to the target level than the application of the DC voltage alone. In this embodiment, an AC voltage which was roughly 1,300 Hz in frequency, sinusoidal in waveform, and roughly 1,900 μA in current value was used as the AC voltage applied to the charge roller 2, whereas a DC voltage of roughly −600 V was used as the DC voltage applied to the charge roller 2.

After the charging of the photosensitive drum 1, the peripheral surface of the photosensitive drum 1 is exposed by an exposing apparatus 3 as a latent image forming means. The exposure selectively removes electric charge from numerous charged points of the peripheral surface of the photosensitive drum 1, forming thereby an electrostatic latent image, which corresponds to an intended image, on the peripheral surface of the photosensitive drum 1. As the exposing apparatus 3, an optical system which separates a color original into monochromatic primary color images, and focuses the monochromatic primary color images on the charged peripheral surface of the photosensitive drum 1 to expose the charged peripheral surface of the photosensitive drum 1, or a scanning laser system, such as a laser scanner, which outputs a beam of laser light while modulating it with picture information in the form of sequential digital electric picture element signals, is employed. Thereafter, the electrostatic latent image is developed by a developing apparatus 4 as a developing means; toner (microscopic coloring particulates) is adhered to the electrostatic latent image.

The developing apparatus 4 is made up of a developing apparatus 4A of the rotary type, and a developing apparatus 4B which is independent the developing apparatus 4A. The developing apparatus 4A of the rotary type has a rotary 4*a*, and three developing devices 4Y, 4M, and 4C mounted in the rotary 4*a*. The developing devices 4Y, 4M, and 4C store yellow (Y), magenta (M), and cyan (C) developers, respectively. These developing devices 4Y, 4M, and 4C are individually placed in the development position in which each developing device opposes the photosensitive drum 1 to supply the photosensitive drum 1 with the toner of the color necessary to develop an electrostatic latent image on the peripheral surface of the photosensitive drum 1. The developing apparatus 4B, which is independent from the developing apparatus 4A, is a developing apparatus 4K, which stores black (K) toner. The developing apparatus 4B can be placed virtually in contact with, or moved away from, the photosensitive drum 1; it is placed virtually in contact with the peripheral surface of the photosensitive drum 1 when developing the electrostatic image on the peripheral surface of the photosensitive drum 1.

Electrostatic latent images corresponding to preset colors, one for one, are sequentially formed on the photosensitive drum 1, and are sequentially developed by the developing devices 4Y, 4M, 4C, and 4K, one for one.

The image forming apparatus 100 is also provided with an intermediary transfer belt 5 (intermediary image transferring member), which is stretched around multiple rollers, being thereby supported by the rollers. The intermediary transfer belt 5 is kept pressed upon the photosensitive drum 1 with the application of a preset amount of pressure, forming thereby a primary transfer nip N1, as a primary transfer station, between the intermediary transfer belt 5 and photosensitive drum 1. The intermediary transfer belt 5 is rotationally driven by a motor or the like (not shown) as a driving means, in the direction indicated by the arrow mark R1 at a peripheral speed slightly different from the peripheral speed of the photosensitive drum 1. In the primary transfer nip N1, a primary transfer roller 6 as a primary transferring means is kept pressed against the photosensitive drum 1, with the presence of the intermediary transfer belt 5 between the primary transfer roller 6 and peripheral surface of the photosensitive drum 1. To this primary transfer roller 6, primary transfer bias is applied from the primary transfer bias application power source (not shown). The primary transfer bias is opposite in polarity (positive in this embodiment) from the polarity (negative in this embodiment) of the charged toner on the photosensitive drum 1. Thus, as toner images different in color are sequentially formed on the photosensitive drum 1, they are sequentially transferred (primary transfer) in layers onto the intermediary transfer belt 5 (synthesization of multicolor image). Obviously, the circumference of the intermediary transfer belt 5 is greater than the length of a sheet of recording medium, on which an image can be formed, and which is conveyable by the image forming apparatus.

After the primary transfer of each toner image, the primary transfer residual toner, or the toner remaining on the peripheral surface of the photosensitive drum 1 after the primary transfer, is removed by a cleaning blade 14 (cleaning member) of a drum cleaning apparatus of the blade type. Thereafter, the peripheral surface of the photosensitive drum 1 is used for the following image formation.

Meanwhile, sheets of transfer medium 24 are fed into the main assembly of the image forming apparatus from a sheet feeder cassette 9 by a feed roller 10, while being separated one by one, and each sheet of transfer medium 24 is conveyed to a secondary transfer nip N2 as a secondary transfer station, with a preset timing, by a pair of registration rollers 11, by way of a transfer guide 12. In synchronism with the arrival of the sheet of transfer medium 24 at the secondary transfer nip N2, a secondary transfer roller 7 as a secondary transferring means is placed in contact with the portion of the inward surface of the intermediary transfer belt 5, which corresponds to the secondary transfer nip N2, with the interposition of a transfer belt 7*a* between the intermediary transfer belt 5 and secondary transfer roller 7. At the same time, transfer bias, which is the same in polarity (negative in this embodiment) as the toner particles of the toner images, different in color and layered on the intermediary transfer belt 5 by the primary transfer, is applied to the secondary transfer roller 7 from a secondary transfer bias application power source (not shown). The application of this transfer bias causes the toner images on the intermediary transfer belt 5 to transfer (secondary transfer) all at once onto the top surface (surface on intermediary transfer belt side) of the recording medium 24 delivered to the secondary transfer nip N2.

The recording medium 24 having received the toner images from the intermediary transfer belt 5 while moving through the secondary transfer nip N2 is conveyed to a fixing device 15 as a fixing means. Then, in the fixing device 15, the recording medium 24 and the toner images thereon are subjected to heat and pressure by a fixation roller 16 and a pressure roller 17, which are being heated so that their temperatures remain at a preset level. As a result, the toner images are fixed. Thereafter, the recording medium 24 bearing the fixed toner images is discharged as a permanent copy from the image forming apparatus 100.

Meanwhile, the toner (secondary transfer residual toner) remaining on the intermediary transfer belt 5 after the secondary transfer is removed with the use of a belt cleaning apparatus 18 of the blade type.

The operations and operational timings of the various members which make up the above described image forming apparatus, the amplitudes of the abovementioned various voltages, etc., are controlled by a controlling means (not shown), such as a CPU.

[Image Formation in Low Speed Mode]

Next, the low speed mode in which the image forming apparatus 100 in this embodiment is operable to reduce the recording medium conveyance speed to ensure that a toner image is satisfactorily fixed will be described. Incidentally, in terms of the portion of the image formation sequence from the beginning of the primary charging of the photosensitive drum 1 to the end of the primary transfer, the low speed mode is identical to the high speed mode. Therefore, this portion of the image formation sequence in the low speed mode will not be described. When it is desired that recording medium is conveyed at a lower speed, for example, when the image forming apparatus is operated in the special paper mode or high image quality mode, the mode selection is inputted into the image forming apparatus. As for the method for inputting the mode selection, the mode selection may be inputted by a user using the control panel of the image forming apparatus, or using a personal computer. Further, the image forming apparatus may be designed so that it automatically detects the size and properties of recording medium.

As soon as the four toner images different in color are layered (primary transfer) on the intermediary transfer belt 5, both the AC and DC biases, which are being applied to the charge roller 2, are turned off in the listed order. Then, roughly 600 milliseconds later, the process speed is reduced to roughly 69 mm/sec by the means for switching the speed of the intermediary transferring member. It is while the toner images are still on the intermediary transferring member when the process speed is switched. Incidentally, the intermediary transferring member speed switching means may be a driving means, such as a stepping motor, or a means for switching the driving voltage system.

When the toner images transferred (primary transfer) onto the intermediary transfer belt 5 before the transfer of the toner image of the last color onto the intermediary transfer belt 5 are moved through the primary transfer station in which the toner image of the last color is being transferred (primary transfer), the toner images transferred before the toner image of the last color had been moved through the secondary transfer nip N2. Thus, it is at the slower speed, to which the speed of the intermediary transfer belt 5 was reduced, that the toner images on the intermediary transfer belt 5 are moved to the secondary transfer nip N2 through the primary transfer nip N1. While these toner images move through the primary transfer nip N1, roughly +50 V of voltage is being applied to the primary transfer roller 6, in order to prevent the toner images from being transferred back onto the photosensitive drum 1 from the intermediary transfer belt 5. In this embodiment, incidentally, while the process speed is roughly 69 mm/sec, or the lower speed, both the AC and DC biases are not applied to the charge roller 2. Further, bias may be applied to the transfer roller, in order to adjust the potential level of the transfer roller to a value at which the toner images do not transfer back onto the photosensitive drum 1 from the intermediary transfer belt 5.

In the secondary transfer nip N2, the secondary transfer roller 7 is pressed against the intermediary transfer belt 5, with the presence of the transfer belt 7*a* between the secondary transfer roller 7 and intermediary transfer belt 5, in synchronism with the timing with which the toner images on the intermediary transfer belt 5 are delivered to the secondary transfer station. Then, the recording medium 24 is delivered to the secondary transfer nip N2 from the pair of registration rollers 11, and conveyed through the secondary transfer nip N2. While the recording medium 24 is conveyed through the secondary transfer nip N2, bias which is the same (negative in this embodiment) in polarity as the toner is applied to the secondary transfer roller 7 from the secondary transfer bias application power source. Therefore, the multiple toner images, different in color, on the intermediary transfer belt 5 are transferred (secondary transfer) all at once onto the recording medium 24, in the secondary transfer nip N2.

After receiving the toner images from the intermediary transfer belt 5 while being conveyed through the secondary transfer nip N2, the recording medium 24 is conveyed to the fixing device 15 as a fixing means. In the fixing device 15, the recording medium 24 and the toner images thereon are subjected to heat and pressure by a fixation roller 16 and a pressure roller 17, which are being heated so that their temperatures remain at a preset level. As a result, the toner images are fixed. Thereafter, the recording medium 24 bearing the fixed toner images is discharged as a permanent copy from the image forming apparatus 100.

As soon as the recording medium 24 is discharged from the image forming apparatus 100, the process speed is increased from roughly 69 mm/sec, or the lower speed mode, to roughly 138 mm/sec, or the higher speed. Thereafter, the DC and AC biases begin to be applied in the listed order, to enter the next phase of the image forming operation.

Meanwhile, the secondary transfer residual toner, that is, the toner remaining on the surface of the intermediary transfer belt 5 after the secondary transfer, is removed with the use of the belt cleaning apparatus 18.

[Toner]

The toner used in this embodiment is manufactured by polymerization. It is roughly spherical particulates, which are no less than 100 and no more than 120 in shape factor SF1, no less than 0.97 and no more than 1.00 in sphericity. The definitions of the shape factor SF1 and sphericity will be given later. Toner which satisfies the above described requirements is excellent in development performance and transferability, being therefore capable of yielding a high quality image. Incidentally, toner which was no less than 120 in shape factor SF1, or no more than 0.97 in sphericity was unsatisfactorily low in transferability, and therefore, it failed to yield a satisfactory image. Next, the method used for manufacturing the toner in this embodiment, and the method used for measuring the properties of the toner, will be described.

Polymer toner is manufactured by polymerizing liquid monomers in suspension. Therefore, its particle diameter can be easily controlled by controlling the shear strength, polymerization temperature, and the like factor.

The polymer toner usable in this embodiment is made up of at least two resinous ingredients A and B, the ratio (A:B) between which is 50:50-95:5. Each toner particle has the surface phase, which is made of mainly resinous ingredient A, and the core phase, which is made up mainly of resinous ingredient B. In terms of temperature combination, it is desired that the phase made up mainly of resinous ingredient A is relatively high in softening point, and the phase made up mainly of resinous ingredient B is relatively low in softening point. However, the phasic structure of toner does not need to be as described above. That is, all that is necessary is that a toner particle as the end product of polymerization has the phase made up mainly of the resinous ingredient A and the phase made up mainly of the resinous ingredient B.

The resinous ingredient A is desired to be 50,000-200,000 in the Mw (molecular weight) measured by GPC (gel permeation chromatography), and 60-100° C. in flow start point measured by a flow tester. Any resinous substance may be used as the material for the resinous ingredient A as long as it is obtainable with the use of suspension polymerization. Further, it may have radicals capable of functioning as charge holding site and/or radicals which improve toner in terms of bondability to paper.

As the monomers which can be polymerized by the above-mentioned suspension polymerization, monomers which belong to the styrene group can be listed, which are: styrene, o-methylstyrene, m-methylstyrene, p-methylstyrene, p-methoxystyrene, etc. Also can be listed as the monomers which can be polymerized are acrylic esters, for example, methyl acrylate, ethyl acrylate, n-butyl acrylate, isobutyl acrylate, n-propyl acrylate, n-octyl acrylate, dodecyl acrylate, 2-ethylhexyl acrylate. There are also stearyl acrylate, 2-chloroethyle acrylate, phenyl acrylate, etc. Further, methacryl esters can be listed as the monomers which can be polymerized, for example, methyl methacrylate, ethyl methacrylate, n-propyl methacrylate, n-butyl methacrylate, isobutyl methacrylate, n-octyl methacrylate, and dodecyl methacrylate. Further, there are 2-ethylhexyl methacrylate, stearyl methacrylate, phenyl methacrylate, dimethyl-aminoethyl, methacrylate, diethyl-aminoethyl methacrylate, etc. Further, acrylonitrile, methacrylonitrile, acrylamide, etc., can be listed as monomers which can be polymerized.

These monomers can be used alone or in mixture. Among the abovementioned monomers, styrene or derivatives thereof are preferable from the standpoint of developmental properties and durability of toner. Styrene or derivatives thereof may be used alone or may be mixed with other monomers.

The resinous ingredient B is desired to be in a range of 300-10,000 in the Mw measured by GPC, and in a range of 30-130° C., preferably, 60-100° C., in melting point. If the melting point of the resinous ingredient B is no higher than 30° C., the resinous ingredient B is likely to have adverse effects upon toner performance; for example, it is likely to cause toner to offset while the temperature of the fixation nip is low. On the other hand, if the melting point of the resinous ingredient B is no less than 130° C., the resinous ingredient B solidifies, failing therefore to satisfactorily polymerize, while toner is manufactured.

It is possible to use wax as the resinous ingredient B. As the waxes usable as the resinous ingredient B, paraffin, polyolefin waxes, and their denatured versions, for example, oxidized versions of these waxes, substances obtained by subjecting the preceding waxes to grafting, may be listed. Further, higher fatty acids, and metallic salts thereof, amide waxes, and the like can also be listed.

The ratio (A:B) between the resinous ingredients A and B needs to be in the range of 50:50-95:5, preferably, 70:30-90:10. If the ratio of resinous ingredient B is greater than 50:50, it is impossible for a toner particle to retain its capsular structure. On the other hand, if the ratio of the resinous ingredient B is no more than 95:5, the resinous ingredient B fails to play its role.

In this embodiment, the phase made up mainly of resinous ingredient B is not present in the portion of a toner particle, which is above the depth equal to 0.15 times the toner particle diameter. That is, the conceptual surface layer of each toner particle in this embodiment has a thickness of 0.15 times the toner particle diameter. Even if the thickness of a certain portion of the conceptual surface layer is no more than 0.15 times the toner particles diameter because of the presence of defects such as cracks, it does not matter as long as the phase made up mainly of the resinous ingredient B is not in this portion. The presence of the phase made up mainly of the resinous ingredient B, in the adjacencies of the conceptual surface layer of a toner particle, which is no thicker than 0.15 times the toner particle diameter, makes the toner particle unstable in terms of capsular structure, rendering the toner particle inferior from the standpoint of blocking prevention.

For transferability or the like, a toner particle is desired to be virtually spherical. The definition of the shape factor SF1, which indicates the shape of the particle shape of the toner used in this embodiment, is as follows: 100 toner particles are randomly selected from a magnified picture of toner. Then, the information of 100 toner particle images is analyzed by inputting the information into an image analyzer (Luzex3: product of Nireko Co., Ltd.). Then, the value calculated using the following mathematical equation is used as the shape factor SF1.

$$SF1=\{(MXLNG)^2/(\text{AREA})\}\times(\pi/4)\times 100.$$

"MXLNG" is the absolute maximum length of a toner particle, and "AREA" is the projected area of a toner particle. The absolute maximum length of a toner means the maximum diameter of the projected image of the toner particle, and the projected area of a toner particle means the size of the projected area of the toner particle.

Shape factor SF1 indicates degree of sphericity. If a particle is perfectly spherical, it is 100 in shape factor SF1. The greater a particle in shape factor SF1, the farther from being spherical, being indeterminate in shape. In this embodiment, the toner particle is desired to be in a range of 100-150 in the shape factor SF1, preferably, 100-200. If a toner particle exceeds 150 in the shape factor SF1, it is unsatisfactorily low in transfer efficiency, being therefore undesirable. The greater a toner particle in the shape factor SF1, the less spherical it is. A toner particle, which exceeds 120 in the shape factor SF1 does not display the properties of a spherical toner particle.

[Measurement of Average Sphericity of Toner]

The average sphericity C of the toner in this embodiment was measured using the following method.

The method used for obtaining the average sphericity C of toner is as follows: the toner particles of the toner are measured with the use of a particle image measuring apparatus of the flow type (FPIA-2100: product of Sysmex Inc.), and the average sphericity C is calculated from the results of the measurement, using the following equation.

$$\text{Circle equivalent diameter}=(\text{projected area of particle}/\pi)^{1/2}\times 2$$

$$\text{Sphericity}=(\text{circumference of a particle equal in area to projected area of the particle})/(\text{circumference of projected area of the particle}).$$

The definition of "projected area of a particle" is the area of the image of a toner particle expressed in a binary system, and the definition of "circumference of projected image of a particle" is the total length of the lines formed by connecting adjacent two edges of the projected image of a toner particle.

The value of the circumference of a particle used for the calculation is that obtained by processing the image of the toner at a resolution of 512×512 (0.3 μm×0.3 μm in picture element size).

In the present invention, sphericity is used as an index for indicating the degree of surface roughness of a toner particle. If a toner particle is perfectly spherical, its sphericity is 1.000. The more uneven in surface the toner particle, the smaller in sphericity value the toner particle.

The average sphericity C of toner, which means the average value of sphericity frequency distribution, is calculated using the equation given in FIG. 7, in which "ci" stands for the sphericity (center value) corresponding to a given divisional point i of particle size distribution, and "m" stands for the number of the measured particles having the sphericity ci.

The measuring apparatus [FPIA-2100], which is used in the present invention, calculates the sphericity of each particle. Then, based on the obtained sphericities, they are classified into classes of the sphericity ranges provided by dividing the range of 0.4-1.0 into equal parts of 0.01 in order to calculate the average sphericity and standard deviation of sphericity of the toner. Then, the average sphericity of the toner is calculated from the center value of the divisional point, and the number of measured particles.

The actual method used for the measurement is as follows. That is, 10 ml of ion exchange water, from which solid impurities and the like were been removed in advance is prepared in a container. Then, a surfactant, preferably, alxylbenzene sulfonate, is added as a dispersant to the ion exchange water. Then, 0.02 g of test sample to be measured is added to the solution, and is evenly dispersed therein. As the dispersing means, an ultrasonic dispersing device, more specifically, Tetral 50 (product of Nikkaki Baiosu Co., Ltd.) is used. The dispersing process is to be carried out for two minutes to obtain a batch of the solution of test sample. During the dispersing process, the solution should be cooled to prevent it from exceeding 40° C. in temperature. Further, in order to prevent the solution from becoming nonuniform in terms of the particle sphericity, the ambient temperature of the particle image analyzing apparatus of the flow type FPIA-2100 is to be controlled so that the internal temperature of the analyzing apparatus remains in a range of 26-27° C. Moreover, the analyzing apparatus is to be set to be automatically focused every preset length of time, preferably, every two hours, with the use of latex particles which are 2 μm in diameter.

For the measurement of the toner in terms of sphericity, the abovementioned particle image measuring apparatus of the flow type is used. The above described solution is readjusted in density so that the toner particle density of the solution will be 3,000-10,000 particles/μl when the toner particles are actually measured. Then, no less than 1,000 toner particles are measured. After the measurement, the data regarding the toner particles which are no more than 2 μm in circle equivalent diameter are eliminated. Then, the average sphericity of the toner particles is obtained.

Further, for the purpose of controlling the chargeability of toner, it is desired to add a charge control agent to the toner material. As the charge control agent, known charge control agents, which hardly interfere with polymerization, and also, hardly contribute to water phase transition, may be listed. As examples of the positive charge control agent usable in this embodiment, nigrosine dyes, triphenylmethane dyes, class IV ammonium salt, amine and polyamine compounds, etc., may be listed. As examples of the negative charge control agent usable in this embodiment, salicylic acid compounds with metallic content, monoazoic dye compounds with metallic contents, styrene-acrylic acid polymer, styrene-methacrylic acid polymer, etc., may be listed.

As the coloring agent, well-known coloring agents may be used. For example, carbon black, iron black, as well as dyes, such as C. I. direct red 1, C. I. direct red 4, C. I. acid red 1, C. I. basic red 1, C. I. mordant red 30, may be used. Further, dyes, such as C. I. direct blue 1, C. I. direct blue 2, C. I. acid blue 9, C. I. acid blue 15, C. I. basic blue 3, C. I. basic blue 5, C. I. mordant blue 7, are usable. Moreover, dyes, such as C. I. direct green 6, C. I. basic greed 4, C. I. basic green 6, can be used. Further, pigments, such as yellow lead, cadmium yellow, mineral yellow, Naples yellow, naphthol yellow, naphthol yellow S, Hansa yellow G, permanent yellow NCG; tartrazine lake, molybdate orange, permanent orange GTR, benzene orange G, cadmium red, permanent red 4R, watching red calcium salt, brilliant carmine 3B, fast violet B; methyl violet lake, Berlin blue, cobalt blue, alkaline blue lake, Victoria blue, quinacridon; and Rhodamine lake, phthalocyamine blue, fast sky blue, pigment green B, malachite green lake, final yellow green, are usable.

When manufacturing toner by polymerization, attention must be paid to the tendency of the coloring agent to interfere with polymerization, and also, the tendency of the coloring agent to affect water phase transition. It is preferable that the coloring agent is modified in surface properties in advance; for example, it is desired that the coloring agent is rendered hydrophobic with the use of substances which do not interfere with polymerization. In particular, many of coloring dyes and carbon black interfere with polymerization. Therefore, attention must be paid to their usage. As the desirable method for modifying coloring dyes in surface properties, it is possible to polymerize monomers in advance, with the presence of these dyes. The obtained colored polymers are added to monomer system. As for carbon black, not only may it be subjected to the same treatment as the abovementioned one to which the dyes are subjected, but also, a substance, such as polyorganosiloxane, which reacts with surface radical of carbon black, may be grafted to carbon black particles.

[Cleaning Member]

Figure 2:
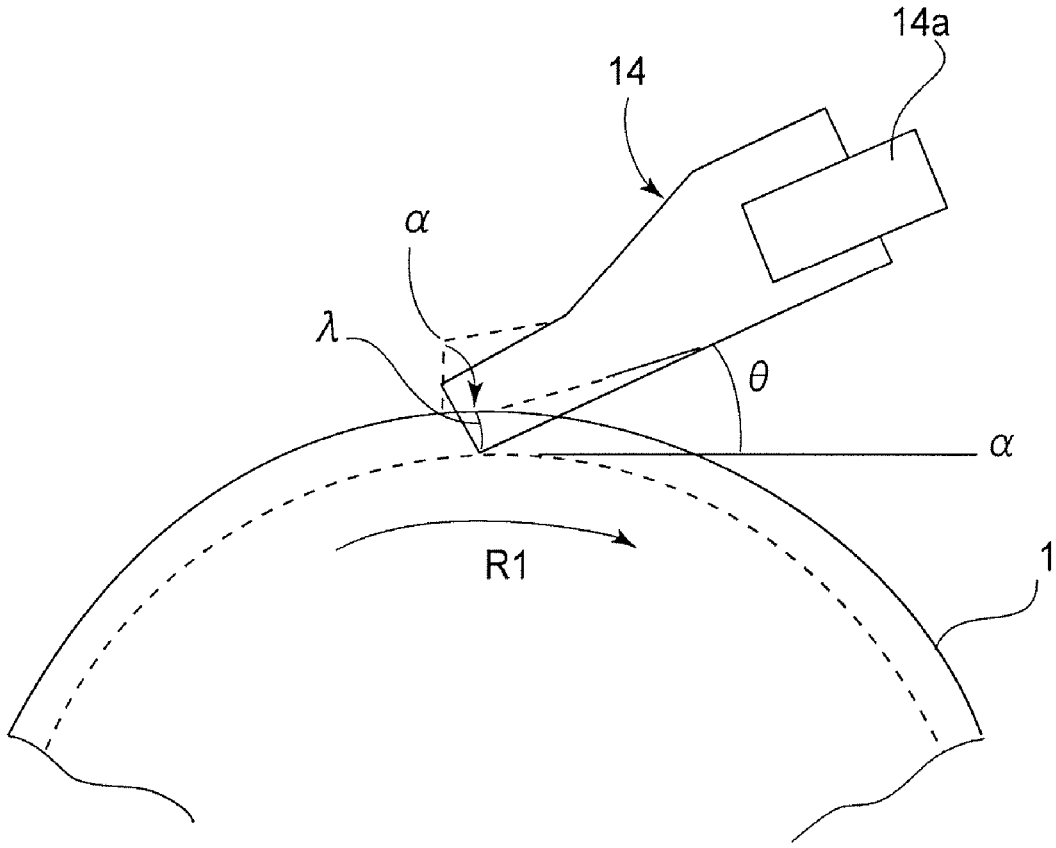
FIG. 2 is a schematic drawing of the cleaning blade and its adjacencies, showing the amount $\lambda$ of apparent intrusion of cleaning blade into the photosensitive drum, and the angle $\theta$ at which cleaning blade is set relative to the photosensitive drum.
Figure 3:
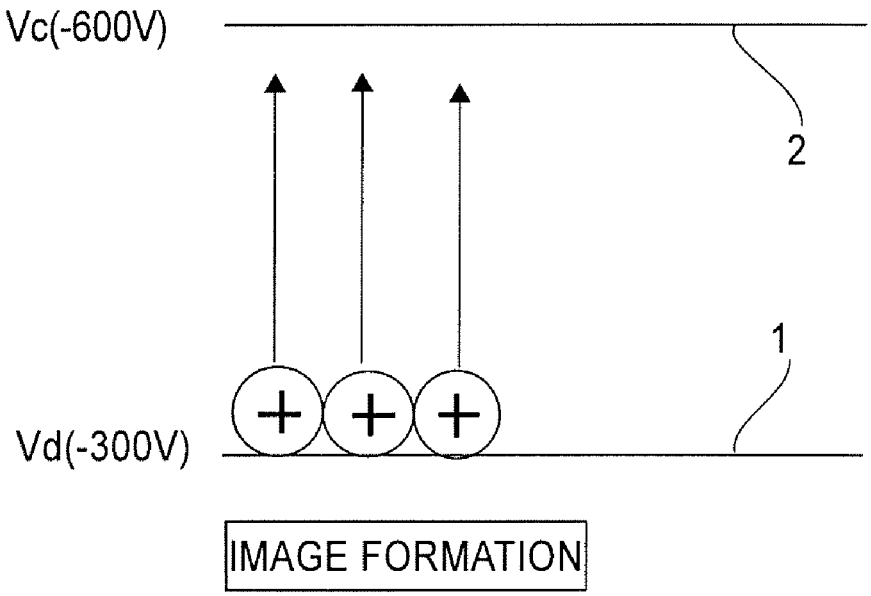
FIG. 3 is a schematic drawing showing the toner transfer from the photosensitive drum onto the charge roller.

Next, the cleaning blade 14 as the cleaning member used in this embodiment will be described further. The cleaning blade 14 in this embodiment is shaped as shown in FIG. 2.

The cleaning blade 14 is a piece of 1.6 mm thick elastic plate formed of an elastic substance such as urethane rubber. It is rectangular, and is disposed so that its longs edges are parallel to the axial line (generatrix) of the photosensitive drum 1. The hardness of the cleaning blade 14 is roughly 70° in Wallace hardness scale (which will be described later). The cleaning blade 14 is placed in contact with the photosensitive drum 1 at a setup angle (θ) of 30° (θ=30°), with an apparent amount of intrusion (λ) of 1.2 mm (λ=1.2 mm). When the photosensitive drum 1 is stationary, the nip width (cleaning nip width: dimension of contact area between photosensitive drum 1 and cleaning blade 14 in terms of circumference direction of photosensitive drum 1) is roughly 100 μm. The cleaning blade 14 (elastic plate) is supported by a holder 14*a* as a holding member, by one of the edge portions in terms of the direction perpendicular to the lengthwise direction, with the opposite edge portion placed in contact with the photosensitive drum 1 so that this edge points upstream in terms of the rotational direction of the photosensitive drum 1. That is, the cleaning blade 14 is tilted in the so-called "cantering" attitude.

Incidentally, Wallace hardness means the hardness of a substance measured with the use of Wallace hardness gauge (Type H12: product of Wallace Co., Ltd.) and IRHD hardness testing method M (micro method). The measurement ambience is 25° C. in temperature and 50% in relative humidity. The hardness of the cleaning blade in this embodiment is in a range of roughly 65°-80° (IRHD Wallace hardness).

Further, the shape of the cleaning blade 14 does not matter, as long as it enables the cleaning blade 14 to satisfactorily remove the transfer residual toner from the peripheral surface of the photosensitive drum 1 to clean the peripheral surface of the photosensitive drum 1.

[Toner Band]

Next, the toner band in this embodiment will be described.

The image forming apparatus 100 has an image counter (not shown) which cumulatively counts the number of images formed during an image forming operation. In this embodiment, the image count is increased by one each time a monochromatic toner image of any color is formed. Thus, when a full-color image based on four primary colors is formed, the image count is increased by four each time a full-color image is formed. As the cumulative image count reaches a preset value, a signal for supplying the toner band is sent. In this embodiment, the referential value for sending the signal for supplying toner band is set to 50.

In this embodiment, a toner band, that is, a solid rectangular image, is formed across a preset area of the peripheral surface of the photosensitive drum 1 by the black developing apparatus 4K while the image forming apparatus 100 is not used for actually forming an image during the on-going image formation. More specifically, while the image forming apparatus 100 is not used for the formation of an actual image, the primary charge bias to be applied to the charge roller 2 is set to roughly −10 V, and the development bias to be applied to the developing device 4K is set to roughly −150 V. With the application of these biases, toner is adhered to the peripheral surface of the photosensitive drum 1 (developed in analog fashion) in a pattern of a band, which is roughly 60 mm wide in terms of the circumferential direction of the photosensitive drum 1, and roughly 310 mm long in terms of the direction of the generatrix of the photosensitive drum 1. The amount of the toner per unit area ($cm^2$) of this rectangular band formed of toner is roughly 0.2 $mm/cm^2$. Thereafter, the primary transfer bias to be applied to the primary transfer roller 6 is floated, causing roughly 90% of the primary transfer residual toner to be transferred onto the cleaning blade 14 of the cleaning apparatus 14. As the toner band is supplied, the abovementioned image counter is reset.

[Toner Ejecting Operation]

As the cleaning blade 14 of the cleaning apparatus of the image forming apparatus in this embodiment is supplied with the toner band, the phenomenon that toner slips out downstream from the nip between the peripheral surface of the photosensitive drum 1 and the cleaning blade 14 gradually starts. On the upstream side of the charge roller 2, the area of the peripheral surface of the photosensitive drum 1, which is bearing the toner having slipped through the nip is roughly −300 V in surface potential Vd, and the charge roller 2 is roughly −600 V in potential level Vc. Therefore, the positively charged toner particles in the toner having slipped out downstream from the nip adhere to the peripheral surface of the charge roller 2. The image forming apparatus 100 in this embodiment is controlled so that these toner particles having adhered to the charge roller 2 are ejected onto the photosensitive drum 1 by a toner ejecting operation, which is a charge roller cleaning operation. In this embodiment, the toner ejecting operation is initiated by a charger roller cleaning process controlling means designed so that as an image formation signal for starting an image forming operation in which the intermediary transferring member is switched in speed during the operation is inputted, it is capable of initiating the ejection of the toner having adhered to the charging member onto the abovementioned image bearing member, before the image forming operation is started. Incidentally, the charge roller cleaning operation controlling means in this embodiment is a controlling means, such as a CPU, for controlling the image forming apparatus.

Figure 5:
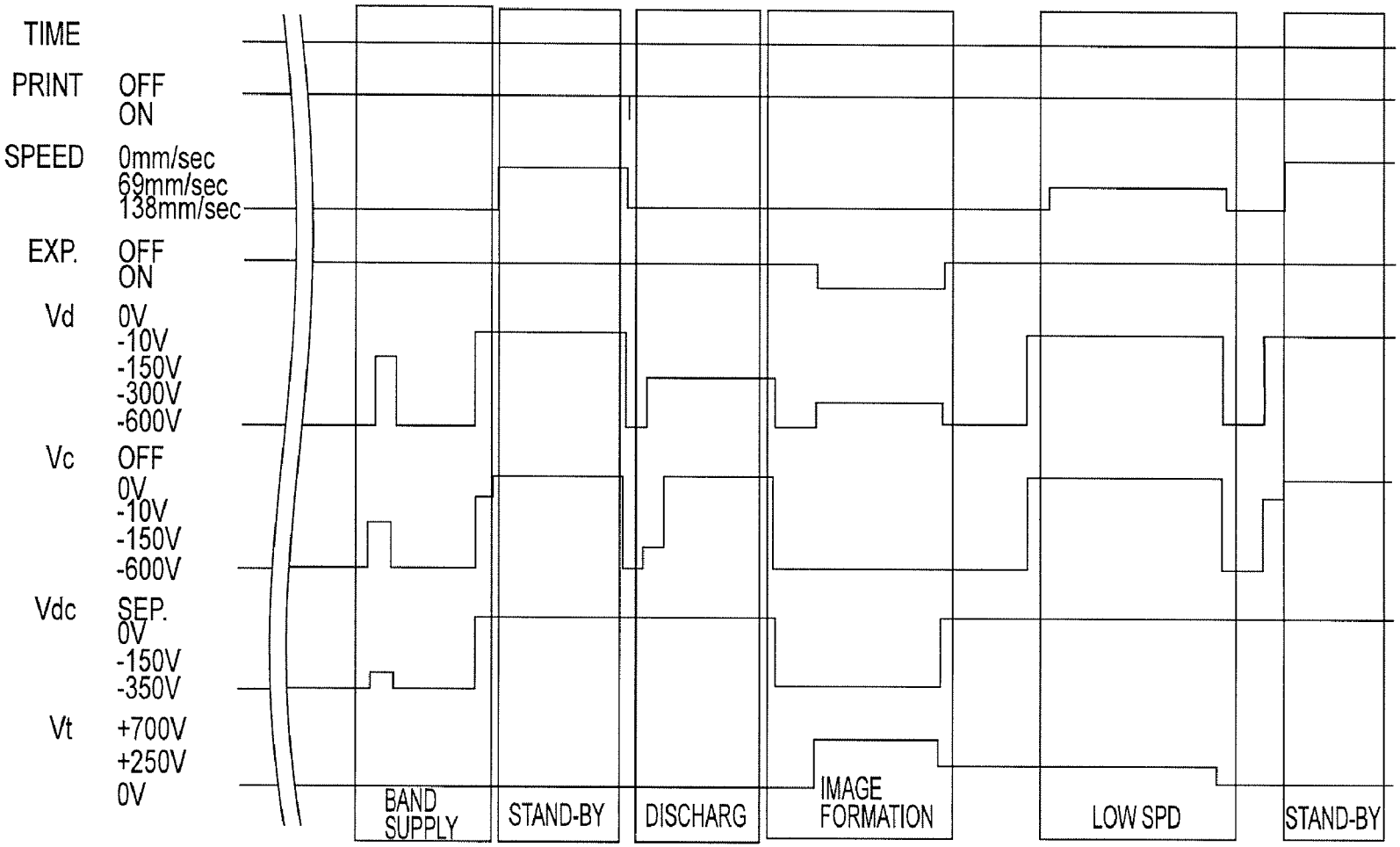
FIG. 5 is an overall timing chart of the image forming operation.
Figure 6:
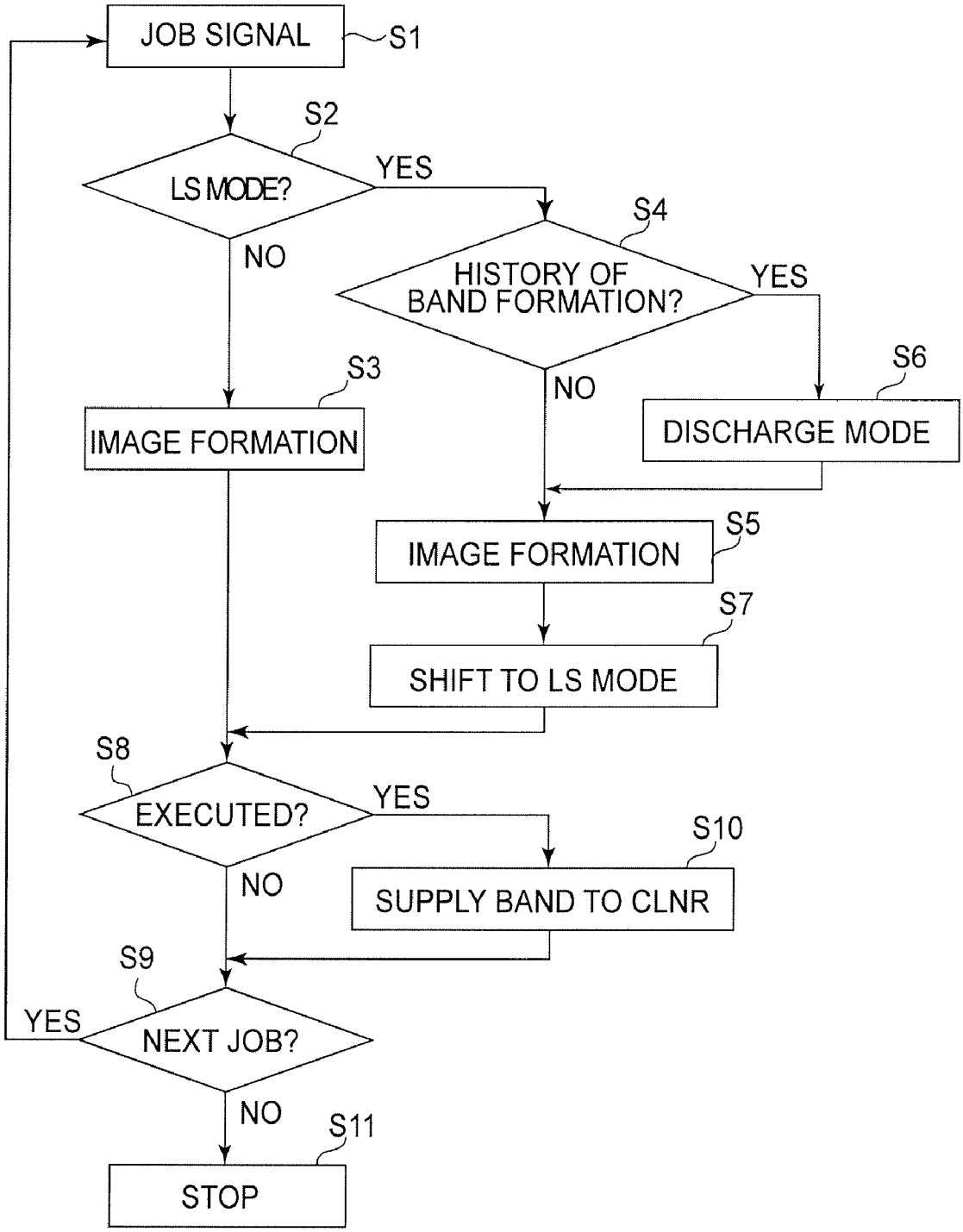
FIG. 6 is a flowchart of the toner ejecting operation.

FIG. 5 is a timing chart showing the operational timings of the abovementioned image forming operation and toner ejecting operation of the image forming apparatus 100. FIG. 6 is a flowchart for the abovementioned image forming operation and toner ejecting operation of the image forming apparatus 100.

First, referring to the flowchart in FIG. 6, the flow of the toner ejecting operation will be described.

As an image formation signal (image formation job signal) is inputted by a user into the image forming apparatus 100 designed as described above (as print command is issued) (Step S1 in FIG. 6, which hereafter will be abbreviated as S1), the controlling means, such as a CPU, checks whether or not the low speed mode, that is, the operational mode in which process speed is switched during an image forming operation, has been selected (S2). Incidentally, it is assumed that instructions regarding an image forming operation and mode selection (such as low speed mode) are to be inputted by a user through an control panel (not shown) with which the main assembly (not shown) of the image forming apparatus 100 is provided. If the controlling means determines that the low speed mode has not been selected (No in S2), the normal image forming operation is carried out (image forming operation is carried out at higher (normal) speed) (S3). If it is determined that the low speed mode has been selected in S2 (Yes in S2), it is checked whether or not the image forming apparatus has a history of toner band formation (S4). That is, the controlling means checks whether or not the cumulative number of times the'image forming apparatus carried out an image forming operation after the toner band was formed last time has exceeded a preset value, that is, 50, at or above which the amount by which toner particles slip out downstream from the abovementioned nip is thought to be significantly large. If there is no history of the toner band formation (No in S4), the intended image forming operation is started in S5. Incidentally, this image forming operation carried out in S5 is the abovementioned portion of the image formation sequence, that is, the portion prior to the primary transfer step, and is carried out at the same speed as in the high speed mode. Then, after the completion of the primary transfer, the process speed is reduced as described above (S7) to carry out the remaining portion of the image formation sequence, that is, the secondary transfer, fixation, etc. If the controlling means determines that there is a history of the toner band formation (Yes in S4), the toner ejecting operation is carried out (S6). The image forming apparatus 100 is set up so that if the low speed mode is selected before the image formation count after the completion of the immediately preceding toner ejecting operation reaches the preset referential value for the toner ejecting operation, the toner ejecting operation is carried out, whereas if the low speed mode is selected after the image formation count after the completion of the immediately preceding toner ejecting operation reached the preset referential value for the execution of the toner ejecting operation, the toner ejecting operation is not carried out. In the former case, the image formation count after the completion of the immediately preceding toner ejecting operation is relatively small. Therefore, a relatively large amount of toner has collected on the cleaning blade 14. Thus, if the low speed mode is carried out in this condition, the amount by which toner slips through under the cleaning blade 14 is relatively large. Therefore, a relatively larger amount of toner adheres to the charge roller 2. Therefore, the toner ejecting operation is carried out before the image forming operation in the low speed mode is carried out. On the contrary, in the latter case, the number of the image forming operations carried out after the completion of the immediately preceding toner ejecting operation is relatively large. Therefore, the amount of toner which the cleaning blade 14 has collected is relatively small. Thus, if the low speed mode is carried out in this condition, the amount of toner which slips through under the cleaning blade 14 is small. Therefore, the amount of the toner which adheres to the charge roller 2 is small, making it unnecessary to carry out the toner ejecting operation right away.

After the toner ejecting operation is carried out (S6), the image forming operation is carried out (S5), and then, the process speed is reduced (S7).

Whether the low speed mode has been selected or not, it is checked in S8 whether or not the toner band is to be formed after the completion of image formation (S8). If it is unnecessary to form the toner band (No in S8), it is checked whether or not the next image formation command has been issued (S9). If there is no image formation command outstanding (No in S9), the driving of the image forming apparatus is interrupted (S10), and the image forming apparatus is put on standby. On the other hand, if an image formation command is outstanding (Yes in S9), Step S1 is taken again. If it is necessary to form the toner band (Yes in S8), the cleaning blade 14 (cleaner) is supplied with the toner band, and Step S9 is taken.

Next, referring to the timing chart in FIG. 5, the toner band formation, toner ejecting operation, image forming operation, and process speed reduction will be described with regard to the relationships among the potentials of the various components, sections thereof, etc., of the image forming apparatus, and the timings with the biases are applied thereto. In FIG. 5, a referential symbol Vd stands for the potential level of the area of the peripheral surface of the photosensitive drum 1 between the charge roller 2 and cleaning blade 14; Vc, primary charge voltage level (potential level of DC component); Vdc, development voltage level; and a referential symbol Vt stands for the primary transfer voltage level. The elapsed time increases from left to right. When Vc is off, the photosensitive drum 1 does not increase in potential even if AC voltage is applied. Therefore, even if AC voltage is not turned off, there is no problem.

In the operation for supplying the cleaning blade 14 with the toner band, the photosensitive drum 1 is rotated at 138 mm/sec, which is the normal process speed. Vd is switched from −300 V to −10 V, and Vc is switched from −600 V to −10 V. Further, Vd is switched from 0 V to 150 V. Vt is kept at 0 V. With these settings, the toner band is formed on the photosensitive drum 1. After the formation of the toner band, Vd, Vc, Vdc, and Vt are all changed to 0 V. Thereafter, Vc is reset to −600 V.

When the toner ejecting operation is carried out immediately after a print command is received, the operational timing is as follows. That is, an area to be charged is preset before the toner ejecting operation is started. Vc is switched from −600 V to −150 V, and the photosensitive drum 1 is charged for a preset length of time, with Vc set at −150 V. Then, Vc is turned off. Thus, the drum potential remains roughly at −150 V. Therefore, the toner having adhered to the charge roller 2 is ejected from the charge roller 2 by the contrast between the potential level of the charge roller 2 and that of the photosensitive drum 1.

For the actual image forming operation, Vd is switched from −150 V to −600 V, and Vc is switched from "Off" to −600 V, whereas Vdc is switched from 0 V to −350 V slightly behind the switching of Vd and Vc. Further, Vt is switched from 0 V to +700 V slightly behind the switching of Vc. Then, the portion of the image formation sequence up to the end of the primary transfer is carried out with the abovementioned settings. Incidentally, the drum potential during the image formation is unstable because the exposing apparatus is on while an image is formed, although the state of nonuniformity is dependent upon the image being formed. In this embodiment, however, it is assumed that the drum potential is −300 V.

In an image forming operation in the low speed mode, the process speed of the photosensitive drum 1 is reduced from 138 mm/sec to 69 mm/sec during the operation. Before the process speed is switched while in the low speed mode, Vc is turned off, and Vd is switched to 0 V. Thus, even if Vc is turned off while toner images are transferred onto the intermediary transferring member, the toner having adhered to the charge roller 2 does not transfer to the photosensitive drum 1.

Next, the abovementioned process of supplying the toner band, and toner ejecting operation, will be further described.

Figure 4:
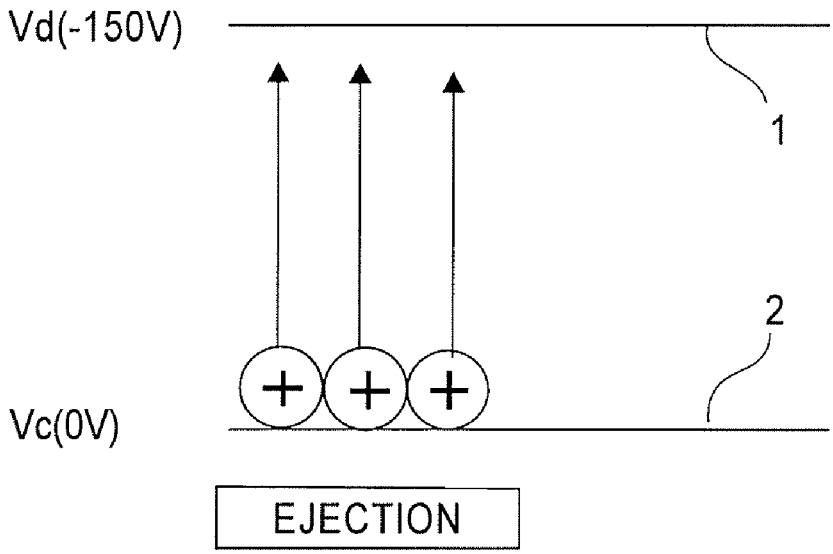
FIG. 4 is a schematic drawing showing the toner ejection from the charge roller onto the photosensitive drum.

Whether or not the toner band has been delivered to the cleaning blade 14 is detected by the abovementioned controlling means. As the controlling means detects the formation of the toner band, it temporarily halts the subsequent portion of the image forming operation. Then, it reduces the surface potential level of the photosensitive drum 1 to roughly −150 V by applying bias with the charge roller 2 for a length of time equivalent to roughly two circumferences of the photosensitive drum 1. As the bias being applied to the charge roller 2 is turned off, the potential of the charge roller 2 falls to 0 V. In this condition, the photosensitive drum 1 and charge roller 2 are idled. As they are idled, the toner having adhered to the charge roller 2 transfers onto the peripheral surface of the photosensitive drum 1, as shown in FIG. 4. They need to be idled no less than a length of time equivalent to one full rotation of the charge roller 2. Obviously, the longer they are idled, the more the amount of toner ejected from the charge roller 2, that is, the smaller the amount of toner remaining on the charge roller 2. However, the longer idling means that more time will elapse before the subsequent portion of the image forming operation can be started. In this embodiment, the photosensitive drum 1 was idled for a length of time equivalent to six full rotations of the charge roller. The toner having been ejected from the charge roller 2 onto the photosensitive drum 1 is recovered by the cleaning blade 14 for cleaning the photosensitive drum 1 or the belt cleaning apparatus 8 for cleaning the intermediary transfer belt 5.

While the toner ejecting operation is carried out, the toner on the development roller of the developing apparatus 4 of a monochromatic image forming apparatus, or the toner on the development roller of each developing apparatus of a full-color image forming apparatus of the tandem type, which has multiple image forming stations, is recovered into the developing apparatus by the application of development bias to be reused. However, in the case of a multicolor image forming apparatus of the rotary type, such as the one shown in FIG. 1, it is possible for multiple toners different in color to mix. Therefore, a multicolor image forming apparatus, such as the one shown in FIG. 1, is desired to be designed so that when it performs the toner ejecting operation, it keeps each of the multiple developing apparatuses separated from the peripheral surface of the corresponding photosensitive drum 1.

[Confirmation of Effects of Present Invention]

FIG. 8 shows the results of tests in which 1,000 copies were continuously printed by the image forming apparatus in this embodiment, using cardstock with a basis weight of 165 g/cm$^2$ as recording medium, to evaluate the image forming apparatus in terms of image contamination.

Condition 1 in FIG. 8 was that the potential level to which the potential of the photosensitive drum 1 was set for the toner ejecting operation is −150 V; the primary charge bias for the charge roller 2 was set to 0 V (turned off); and the photosensitive drum 1 was idled for 10 seconds. Under this condition, the toner band was formed 20 times, that is, once every 50 sheets of recording medium, and each time the toner band was formed, the toner ejecting operation was carried out. Yet, no contamination attributable to the toner having adhered to the charge roller 2 was detected across the images formed after the toner band formation. When an image forming operation similar to that carried out under Condition 1 was continuously carried out under Condition 2 in FIG. 8 in which the toner ejecting operation was intentionally left out. Under this condition, image contaminations which were in the form of a long and narrow stripe were detected across the images formed after the toner band was formed. Condition 3 was similar to Condition 1 except that the former was two seconds in the length of time the photosensitive drum 1 was idled in the toner ejecting operation. Under Condition 3, the image contamination occurred although they were virtually invisible. Under Condition 4, in which the length of time for the photosensitive drum 1 was idled in the toner ejecting operation was 30 seconds, which was substantially longer than that in Condition 1. Under this condition, not only did no image contamination occur, but also, other problems did not occur. Lastly, Condition 5 was that the potential of the photosensitive drum 1 was set to 0 V, which was the same as that of the primary charge voltage. Under this condition, the image contamination occurred. In other words, the results given in FIG. 8 confirm the effectiveness the present invention.

Incidentally, this embodiment was described with reference to the low speed mode, that is, the mode for ensuring satisfactory image fixation, in which the image contamination attributable to the toner ejection from the charge roller 2 is most conspicuous. However, it is possible that the problem of image contamination will occur even in an ordinary image formation mode, if the relationship between the potential of the charge roller 2 and that of the photosensitive drum 1 happens to turn into such a relationship that the toner transfers from the charge roller 2 onto the photosensitive drum 1. Therefore, it is desired that a toner ejection operation, such as the one described above, is carried out even before the start of an image forming operation in the ordinary mode.

In this embodiment, the image forming apparatus was designed so that the toner ejecting operation was carried out after the toner band was formed. However, the image forming apparatus may be designed so that the toner ejecting operation is also carried out in the situation other than after the toner band is formed, for example, after paper jam is dealt with or after the formation of a high density image. More specifically, after the paper jam is dealt with or during the formation of high density images, a large amount of transfer residual toner is sent to the cleaning blade 14 of the cleaning apparatus. That is, as paper jam occurs, the entirety or a part of the image on the photosensitive drum 1 fails to be transferred, and is sent to the cleaning blade 14. Therefore, the amount of the toner which slips through under the cleaning blade 14 increases, intensifying the contamination of the charging member. Therefore, if it is determined from the operational history of the image forming apparatus that the image formation count has not reached the preset reference value for carrying out the toner ejecting operation, the toner ejecting operation is carried out before the process speed is reduced while the image forming apparatus is operated in the low speed mode. In other words, the image forming apparatus may be designed so that if it is determined that a large amount of toner has reached the cleaning blade, the toner ejecting operation is carried out before the process speed is reduced during an image forming operation carried out in the low speed mode.

Further, the image forming apparatus may be designed so that the operation for ejecting toner from the charge roller is carried out during a period other than immediately before the process speed is reduced in the low speed mode, for example, during a period, such as a preparatory period in which the image forming apparatus is prepared for image formation, in addition to immediately before the abovementioned process speed reduction in the low speed mode. In such a case, the image forming apparatus may be designed so that the information regarding image formation, for example, the number of sheets of recording medium on which an image has been formed, the number of video signals, etc., are counted, starting from the completion of the immediately preceding toner ejecting operation, and the toner ejecting operation is carried out if it is determined, while the image forming apparatus is operated in the low speed mode, that one of these numbers has reached the corresponding preset value.

In this embodiment, the image forming apparatus was of the single drum type. However, the present invention is applicable to various image forming apparatuses other than an image forming apparatus of the single drum type. For example, the present invention is applicable to an image forming apparatus of the tandem type, which is designed so that multiple toner images are transferred from multiple drums, one for one, onto the intermediary transferring member, and the process speed is switched after the transfer of the toner images onto the intermediary transferring member. Such an application is not problematic at all.

As described above, the present invention can minimize the effect which the toner having adhered to the charging member, has upon the image on the intermediary transferring member, if the charge bias being applied to the charging member is turned off after the process speed is switched after the formation of a toner image (toner images) on the intermediary transferring member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 351363/2005 filed Dec. 5, 2005 which is hereby incorporated by reference.

What is claimed is:

1. An image forming apparatus comprising:

a rotatable image bearing member;

a charging member contacted to said image bearing member to charge said image bearing member;

an electrostatic image forming device for forming electrostatic images on said image bearing member charged by said charging member;

a plurality of developing devices for developing the electrostatic images into toner images on said image bearing member;

an intermediary transfer member, rotatable along an endless path, for carrying the toner images superimposedly transferred from said image bearing member at a first transfer position, wherein the toner images are transferred onto a recording material at a second transfer position;

a cleaning member for removing toner remaining on said image bearing member after transfer of the toner image;

a speed switching device for selectively setting a speed of the recording material from a plurality of levels;

an intermediary transfer member speed switching device for switching a rotational speed of said intermediary transfer member, wherein said image forming apparatus is operable in a mode in which said intermediary transfer member speed switching device switches the rotational speed of said intermediary transfer member after the toner images are transferred from said image bearing member onto said intermediary transfer member;

a charging control device for rendering off a DC voltage applied to said charging member after the transfer of the toner image onto said intermediary transfer member and while said intermediary transfer member is carrying the toner image, wherein when an operation is executed in an image forming mode in which said intermediary transfer member speed switching device switches the speed of said intermediary transfer member, after a last image is superimposedly transferred onto the intermediary transfer member, the toner images on the intermediary transfer member are passed through the second transfer position without image transfer and then through the first transfer position, and thereafter are transferred onto the recording material in the second transfer position; and a controller for executing, prior to an image forming operation, a cleaning operation in which toner on said charging member is transferred onto said image bearing member, when an image formation signal indicative of the image forming mode is inputted, wherein said controller, during the cleaning operation prior to the image forming operation:

a) causes said charging member to charge said image bearing member to a predetermined potential, and then b) controls, when an area of said image bearing member which is charged to the predetermined potential arrives again at a position opposing said charging member, a potential of said charging member such that an absolute value thereof is smaller than an absolute value of the surface potential of said image bearing member to cause the toner on said charging member to transfer onto said image bearing member.

2. An apparatus according to claim 1, wherein the toner is polymerized toner provided by polymerization, a maximum absolute length MXLNG of a particle constituting the toner, and a projected area, AREA, of the particle satisfy:

$$100 \leqq SF1 = \{(MXLNG)^2/\mathrm{AREA}\} \times (\pi/4) \times 100 \leqq 120.$$

3. An apparatus according to claim 2, wherein an average of circularities of particles constituting the toner is not less than 0.97 and not more than 1.00, wherein the circularity is defined as (a circumference length of a circle having the same area as the projected area of the particle)/(a circumference length of a projected image of the particle).

4. An apparatus according to claim 1, wherein said controller executes the cleaning operation on the basis of image information or a count of the image forming operation after a previous cleaning operation.

5. An apparatus according to claim 1, wherein said image forming apparatus is operable in a supply mode in which the toner is supplied to said cleaning member for each predetermined number of image formations, and said controller executes the cleaning operation on the basis of a count of image formations after a previous operation of the supply mode.

* * * * *